US007654063B2

(12) United States Patent
Forss

(10) Patent No.: US 7,654,063 B2
(45) Date of Patent: Feb. 2, 2010

(54) METHOD AND DEVICE FOR GAS FILLING AND SEALING OF A DUCT INTENDED TO BE FILLED WITH GAS AND POSITIONED IN A CONTAINER OF A COLLAPSIBLE TYPE, AND CONTAINER BLANK COMPRISING SUCH A DUCT

(75) Inventor: Stefan Forss, Helsingborg (SE)

(73) Assignee: ECO Lean Reasearch & Development A/S, Copenhagen (DK)

( * ) Notice: Subject to any disclaimer, the term of this patent is extended or adjusted under 35 U.S.C. 154(b) by 236 days.

(21) Appl. No.: 10/572,553

(22) PCT Filed: Sep. 29, 2004

(86) PCT No.: PCT/SE2004/001386

§ 371 (c)(1),
(2), (4) Date: Mar. 17, 2006

(87) PCT Pub. No.: WO2005/030599

PCT Pub. Date: Apr. 7, 2005

(65) Prior Publication Data

US 2007/0068118 A1 Mar. 29, 2007

(30) Foreign Application Priority Data

Oct. 2, 2003 (SE) ..... 0302633

(51) Int. Cl.
*B65B 31/00* (2006.01)

(52) U.S. Cl. ..... 53/434; 53/512; 493/313; 493/924; 493/926

(58) Field of Classification Search ..... 53/403, 53/433, 434, 88, 511, 512; 493/267, 313, 493/314, 924, 926, 968
See application file for complete search history.

(56) References Cited

U.S. PATENT DOCUMENTS 2,245,738 A * 6/1941 Taylor ..... 206/568

(Continued)

FOREIGN PATENT DOCUMENTS

FR 1.318.719 A 11/1963

(Continued)

*Primary Examiner*—Paul R Durand
(74) *Attorney, Agent, or Firm*—Birch, Stewart, Kolasch & Birch, LLP

(57) ABSTRACT

The invention relates to a method and a device (16) for gas filling and sealing of a duct (7) intended to be filled with gas and positioned in a container (1) of a collapsible type. The duct (7) is defined by two opposite side walls (2) which are joined along a connecting portion (4) and comprises an inlet (15) arranged in one of the side walls (2). A part of the container (1) that comprises the inlet (15) is clamped between an abutment (17) and a gas module (20) which is axially movable towards the abutment (17). Clamping occurs in such a manner that one of the two side walls (2) included in the duct (7) is allowed, in response to a gas flow supplied from the gas module (20) and entering the duct (7) through said inlet (15), to bulge to form a free passage into the duct (7) for filling the same with gas. After completion of the gas filling, the duct (7) is sealed. The invention also relates to a container blank (10) having a duct (7) which is specially developed for the method and the device (16).

6 Claims, 4 Drawing Sheets

U.S. PATENT DOCUMENTS

| | | | | | |
|---|---|---|---|---|---|
| 3,382,642 | A | * | 5/1968 | Shaw | 53/434 |
| 3,692,613 | A | * | 9/1972 | Pederson | 156/498 |
| 4,216,639 | A | * | 8/1980 | Gautier | 53/413 |
| 4,219,054 | A | * | 8/1980 | Carter et al. | 141/10 |
| 4,361,235 | A | * | 11/1982 | Gautier | 206/527 |
| 4,377,192 | A | * | 3/1983 | Gautier | 383/7 |
| 4,411,123 | A | * | 10/1983 | Gautier | 53/550 |
| 4,731,978 | A | * | 3/1988 | Martensson | 53/468 |
| 4,805,378 | A | * | 2/1989 | Anderson | 53/426 |
| 4,999,978 | A | * | 3/1991 | Kohlbach et al. | 53/512 |
| 5,137,154 | A | * | 8/1992 | Cohen | 206/522 |
| 5,788,121 | A | * | 8/1998 | Sasaki et al. | 222/105 |
| 6,244,466 | B1 | | 6/2001 | Näslund | |
| 7,024,836 | B2 | * | 4/2006 | Powell et al. | 53/469 |

FOREIGN PATENT DOCUMENTS

| | | |
|---|---|---|
| GB | 1 598 843 A | 9/1981 |
| SE | 518 406 C2 | 10/2002 |

* cited by examiner

METHOD AND DEVICE FOR GAS FILLING AND SEALING OF A DUCT INTENDED TO BE FILLED WITH GAS AND POSITIONED IN A CONTAINER OF A COLLAPSIBLE TYPE, AND CONTAINER BLANK COMPRISING SUCH A DUCT

FIELD OF THE INVENTION

The present invention relates to a method and a device for gas filling of a duct intended for the purpose and positioned in a container of a collapsible type. The invention also relates to a container blank having a duct intended to be filled with gas.

BACKGROUND ART

It has been known for a long time to use containers of a collapsible type, for example, for foodstuffs or expendable material such as sanitary articles and detergents. The contents can be both in liquid and in powder form.

By a container of a collapsible type is meant the type of container that consists of thin flexible walls which are joined in connecting portions to define a compartment. The volume of the compartment depends on the relative distance between the walls, which means that the volume depends on the filling ratio of the container.

This type of containers may have a number of different handle shapes, one of which is shown in WO 99/41155. This handle forms a hole pattern through which a user's hand can be inserted so that the container can be gripped and handled like a jug.

In SE 518,406, a corresponding container type has been further developed by gas-filled ducts being arranged in the connecting portion along at least one side of the container. The main purpose of this type of gas-filled duct is to increase the stability of the container, but also to make it more comfortable to grip. The gas-filled duct shown in this document is arranged to be filled in connection with the filling of the container with its contents. How this gas filling is done or how such equipment is designed has not been described.

Containers of a collapsible type are as a rule filled through a duct/opening which is defined by two opposite walls of the container. Such filling occurs with the container in an upright position, in which case the filling nozzle can act essentially in the vertical direction and be introduced into the duct between the two walls. This is a method that is well established and well functioning when supplying fluids in liquid form. The same method, however, causes great problems when supplying fluids in gaseous form due to difficulties in providing a gas-tight seal around the nozzle while the gas is being supplied. Additional problems arise when the gas-filled duct is to be sealed.

A solution to these problems is that the duct is filled with gas through a check valve integrated in the container. This technique is very expensive to apply to mass-produced containers, such as food containers where the duct is to be filled only once.

Therefore there is a need for a method and a device for gas filling of such ducts in collapsible containers, independently of the purpose of the gas-filled ducts. There is also a need for a further development of the construction of the duct to allow, in industrial use, easy filling with gas and also easy sealing. It will be appreciated that the duct intended for the purpose is not intended to be refilled.

OBJECTS OF THE PRESENT INVENTION

The object of the present invention is to provide a device and a method for gas filling of ducts in containers of a collapsible type.

The method and the device should be easy to use and allow a high rate of production and great reliability.

A further object of the invention is to provide a container blank which has a duct that is suitably designed for the device and the method.

The duct should have such a construction that no new material or components in the form of, for example, check valves have to be added to the container blank.

SUMMARY OF THE INVENTION

To achieve at least one of the above objects and also other objects that will appear from the following description, a method, a device and a container blank are provided according to the present invention.

More specifically, a method of gas filling and sealing of a duct intended to be filled with gas and positioned in a container of a collapsible type is provided, said duct being defined by two opposite side walls which are joined along a connecting portion, and comprising an inlet arranged in one of the side walls. The method is characterised by clamping a part of the container, which part comprises said inlet, between an abutment and a gas module which is axially movable towards the abutment, in such a manner that one of the two side walls included in the duct is allowed, in response to a gas flow supplied from the gas module and entering the duct through said inlet, to bulge to form a free passage into the duct for filling the same with gas and, after completion of the gas filling, sealing the duct.

During gas filling, the container is thus clamped by a grip over the part of the container which comprises the inlet, i.e. a part of the duct. Subsequently gas is supplied to the duct through a gas module acting in the clamping direction. Both the clamping direction and the operating direction of the gas module are thus oriented more or less perpendicular to the direction of extension of the duct. Although clamping occurs over the part of the container that comprises the inlet, one of the walls defining the duct is allowed to bulge to provide a free passage into the duct. The method is very simple and advantageous compared with prior-art technique as described above, in which the two side walls that define the duct and form its inlet must be separated, after which the nozzle intended for gas filling can be introduced into the duct in the longitudinal direction thereof while at the same time the nozzle has a clamping effect on the duct in a direction transversely to the direction of gas filling. The need for any check valves is completely eliminated.

It is preferred for said part of the container to be clamped by axial displacement of a nozzle and a packing means, which is arranged outside the same and associated with the gas module, in relation to said abutment.

Moreover it is preferred for the abutment to be formed with a recess in its side facing the container to allow said bulge. Such a recess allows a portion of the side walls forming the duct to bulge during the supply of gas and, thus, form a free passage into the duct although the part of the container that comprises the inlet to the duct is clamped by gripping over precisely the duct.

After completion of the gas filling, it is advantageous to seal the duct by applying heat and pressure to the duct part which abuts against the abutment. Precisely heat sealing is a most advantageous method since it is quick and does not require any extra supply of material. Moreover heat sealing provides in a simple manner a gas-tight seal.

According to another aspect, the invention relates to a device for gas filling and sealing of a duct intended to be filled with gas and positioned in a container of a collapsible type, said duct being defined by two opposite side walls, which are joined along a common connecting portion, and comprising an inlet arranged in one of the side walls. The device is characterised by an abutment, and a gas module which is axially applicable to the abutment to abut against a part of the container and the inlet arranged therein, the gas module being arranged to fill the duct with gas through the inlet and to seal the duct after completion of the gas filling.

The construction of the device is very simple. The gas module allows the same operating direction for all functions, i.e. holding the container, filling its duct with gas and the subsequent sealing. The device requires no additional means on the container in the form of, for example, check valves or separate inlets.

In a preferred embodiment, the gas module comprises a nozzle which is applicable to the inlet for supplying gas to the duct. A packing means is arranged around the nozzle and applicable to the abutment to seal around the nozzle. The packing means is intended to prevent unnecessary gas leakage during the gas filling process.

The nozzle and the packing means can be arranged on a common unit in the form of a first piston rod, said first piston rod comprising a bore for supplying gas to the duct through the nozzle. The integration of the connection between the gas source and the nozzle in the piston rod eliminates the need for a separate gas supply duct which by the movement of the gas module relative to the abutment would require frequent maintenance.

It is also preferred for the gas module to comprise a sealing means which is adapted, after filling the duct arranged in the container with gas, to disconnect the inlet from the duct by sealing. This sealing means preferably comprises a mandrel which is axially engageable with a heating jaw. Sealing thus occurs by a combination of pressure and heat and produces melting-together of at least the surface layers of the two opposite side walls which define the duct. The sealing should establish a gas-tight seal of the duct.

The heating jaw can be arranged outside the abutment. Alternatively, the mandrel can be arranged outside the abutment. Depending on which alternative is chosen, it is preferred for either the mandrel or the heating jaw to be arranged as a second piston rod outside the first piston rod, which allows simplified control of the movements of the piston rods. If the heating jaw is arranged outside the abutment, the heating jaw can be the same as used when closing the duct means in the container, through which duct means the container is filled with its contents. Such a solution allows very compact and space-saving equipment for manufacturing containers.

In another preferred embodiment, the first piston rod comprises an external lug which, during a return stroke of the first piston rod, is engageable with the second piston rod for returning the same. This results in a very simple and reliable return stroke of the piston rods.

It is preferred for the abutment to comprise, in its plane, a groove for receiving the bulge, resulting during filling of the duct with gas, of at least one side wall. This results in a free passage into the duct through the inlet although the container is clamped between the gas module and the abutment by a clamping effect over a part of the duct.

It is advantageous if the abutment is made of a material with low thermal conductivity. This is applicable especially if the abutment is enclosed by a heating jaw. This eliminates the risk that the abutment reaches such a temperature that the container material is thermally affected and causes uncontrolled joining. It is also possible to provide the abutment with cooling means, for instance in the form of cooling coils.

According to another aspect, the invention relates to a container blank which is intended for a container of a collapsible type, said container blank comprising a duct which is intended to be filled with gas and which is defined by two opposite walls which are joined along a common connecting portion. The container blank is characterised in that the duct comprises a first segment which after gas filling provides a geometry desired in the container; a second segment adjoining the first segment, said second segment having a significantly smaller cross-sectional area than the first segment; and a third segment adjoining the second segment and comprising an inlet to the duct.

This division of the duct into segments where the second segment has a significantly smaller cross-sectional area than the first segment implies that the gas supplied to the duct is capable of expanding the first segment, but not the second segment. This means that the second segment, also when the first segment is fully expanded, is essentially flat. Consequently a sealing means that is arranged over the second segment need only expel a small amount of gas before full engagement between the two opposite side walls of the duct can be achieved to produce a gas-tight seal.

The first segment should have such a geometry as to provide a desired technical function in the completed container, for instance in the form of a comfortable handle-forming bead or a stiffening duct.

The inlet preferably is a hole formed in one side wall. Such an inlet construction is the simplest possible one and requires no addition of further material or components in the form of, for example, check valves.

It is preferred for the third segment to be arranged in connection with a duct means of the container blank, through which duct means the container blank is adapted to be filled with its contents. This means that the device used for filling the duct with gas can be arranged in direct connection with the device that is used to seal the container after it has been filled with its contents. The position of the inlet in one of the side walls, in combination with the sealing of the duct means conventionally occurring transversely to the duct means, implies that the two devices can act in a common direction and even in such a manner that the movements of the two devices can be coordinated since sealing of the duct as well as the duct means suitably occurs in a thermal way.

DESCRIPTION OF DRAWINGS

The invention will now be described in more detail by way of example and with reference to the accompanying drawings which illustrate currently preferred embodiments of the device and the container blank.

TECHNICAL DESCRIPTION

Figure 1:
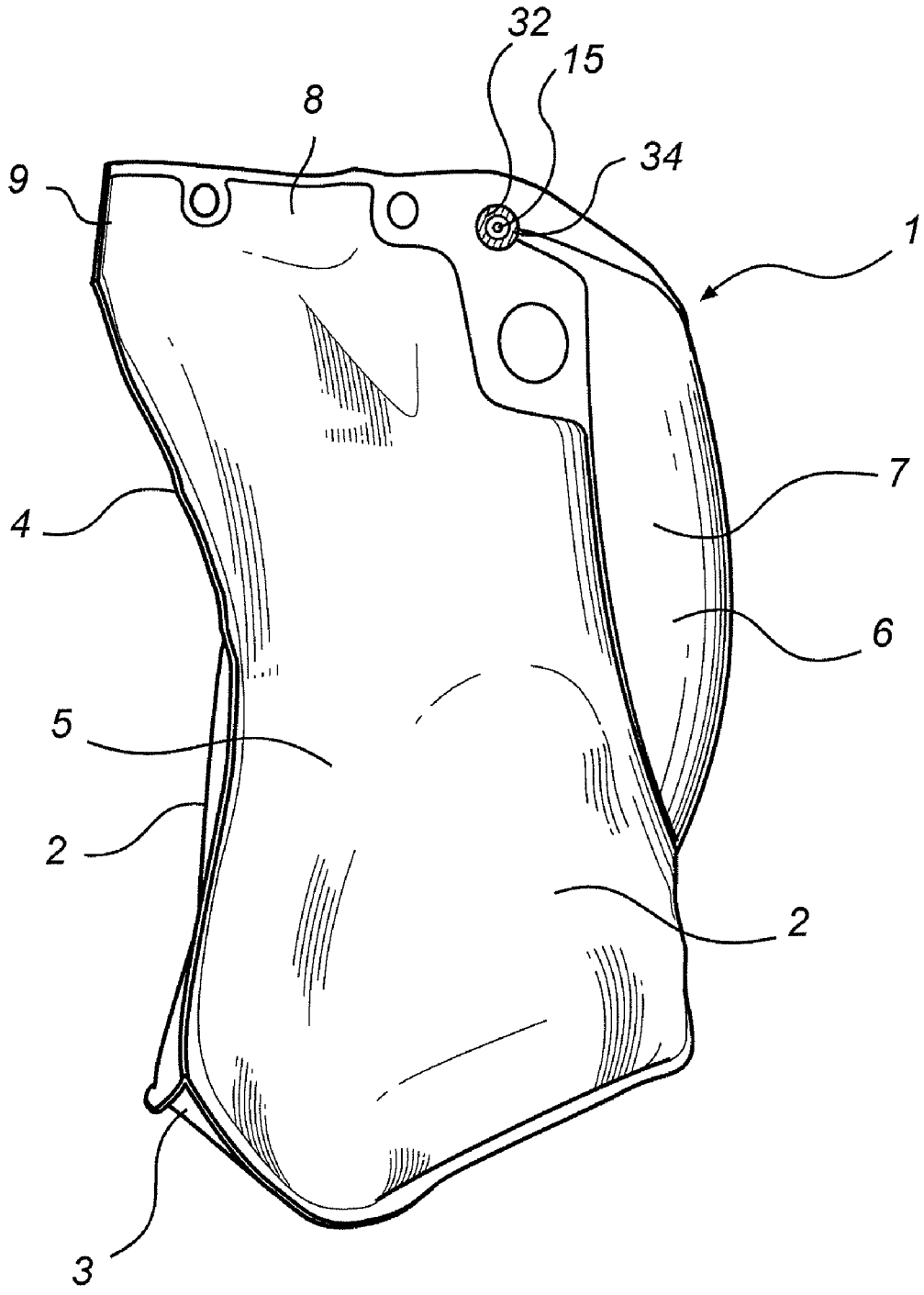
FIG. 1 shows an example of a container of a collapsible type comprising a gas-filled, handle-forming duct.

With reference to FIG. 1, an example of a collapsible container 1 is shown, to which the present device and method have been applied.

The container is especially intended for liquid foodstuffs such as milk, water, juice or wine, but it may, of course, also be intended for products in some other form or for other purposes.

The container comprises three flexible walls, two of which constitute side walls 2 and the third constitutes a bottom wall 3. The walls are joined along connecting portions 4 to define a compartment 5. The walls 2, 3 are made of a bendable and flexible material, which means that the volume of the compartment 5 depends on the relative distance between the walls 2, 3. The volume of the compartment 5 is thus directly dependent on the filling ratio of the container 1. In other words, the container is of a collapsible type.

The walls 2, 3 of the container 1 are preferably joined in the connecting portions 4 by welding. Also other methods of joining, such as gluing, are conceivable.

A handle 6 is arranged in the connecting portion 4 at the rear end of the container 1. The handle 6 consists of a gas-filled duct 7 which is defined by the connecting portion 4 and the side walls 2 of the container 1. By gas is preferably meant air, but of course also other gases or even liquids may be used. The handle 6 has such a geometry and filling ratio as to form an easy-to-grip bead. The handle 6 also promotes by its geometry and gas filling a considerable rigidity of the container 1.

The container 1 has centrally in its upper part a duct means 8 through which the container has been filled. This has occurred by a portion (not shown) in the upper part of the container being separated, after which a filling nozzle (not shown) has been inserted into the container through the duct means for filling of the container. After completion of the filling, the filling nozzle is removed, after which the container is once more sealed to form a new connecting portion in the upper part of the container.

The shown container 1 has at its upper front end an opening portion 9 which is formed as a spout. To open the container 1, an outer end of the opening portion 9 is separated, thereby making the compartment 5 communicate with the environment. The outer end can be separated, for example, by cutting or tearing off. The container 1 can thus be emptied in a pouring motion like a jug.

Generally it is desirable for the selected container material to consist of a laminate comprising a core layer of mineral-based filler and a binder of polyolefin. It will be appreciated that also other materials are possible.

Figure 2:
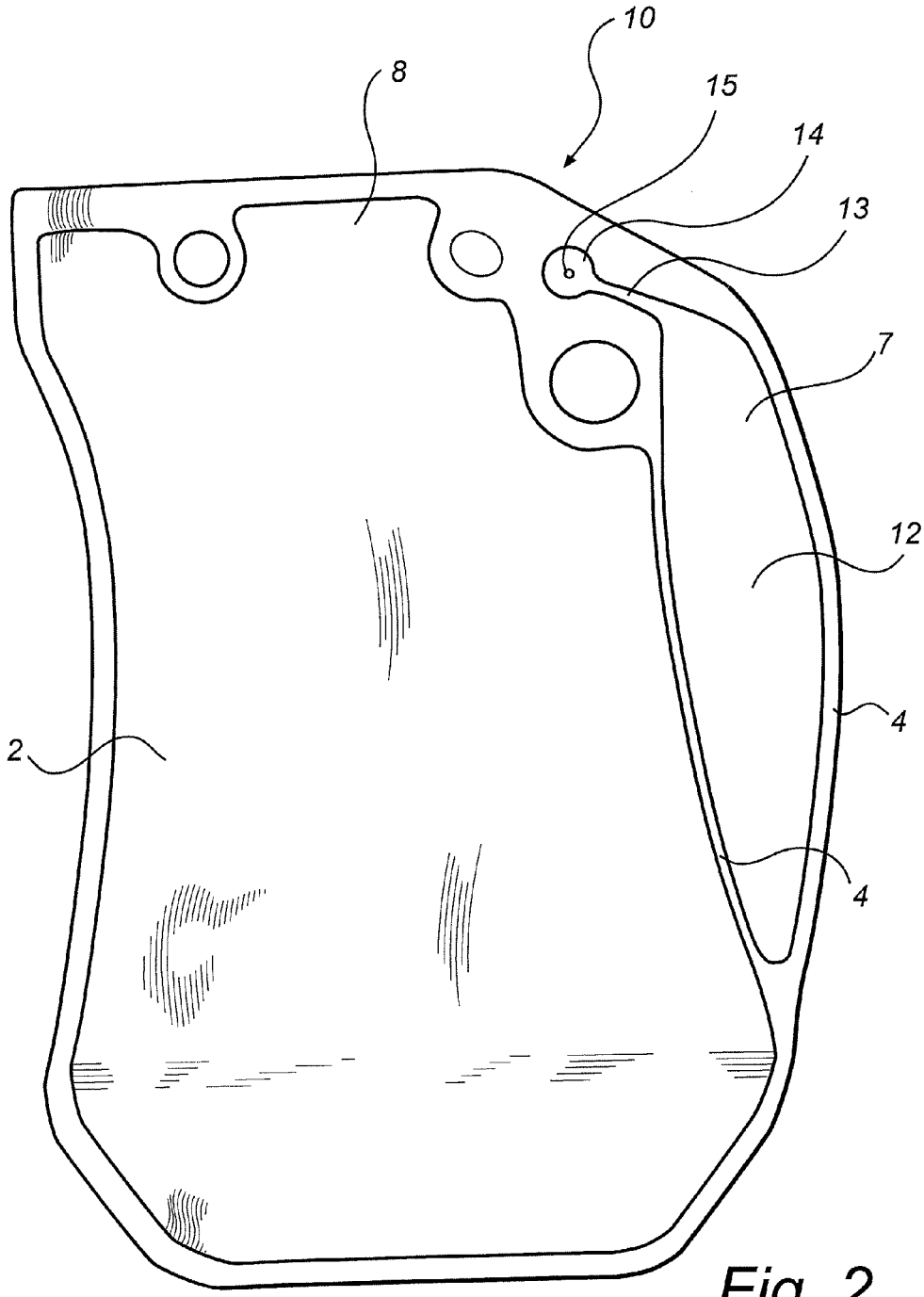
FIG. 2 illustrates a container blank corresponding to the container shown in FIG. 1.

With reference to FIG. 2, a container blank 10 corresponding to the container 1 shown in FIG. 1 is illustrated.

At the rear end of container blank 10, the handle-forming duct 7 intended to be filled with gas is shown. The duct 7 is defined by the two side walls 2 and a peripheral connecting portion 4.

The duct 7 is divided into three segments which all communicate with each other. The first segment 12 comprises the part that is intended to form the actual handle 6. The first segment 12 thus is the segment which in the completed container gives the desired function, whether, like in the shown and described example, it consists of a handle or it provides some other function, such as a stiffening effect. A second segment 13 is directly connected to the first segment 12 and constitutes a narrow duct that will be described below. A third segment 14 is directly connected to the second segment 13. The third segment 14 consists in its simplest form of an area with a hole 15 in one side wall 2. The hole 15 thus constitutes an inlet to the duct 7, through which inlet the duct communicates with the environment before being filled with gas and sealed. The third segment 14 preferably has such a surface area as to allow minor position deviations between the container blank 10 and the gas module which is used for filling the duct 7 with gas.

As mentioned above, the second segment 13 constitutes a narrow duct. Its main function is to form a surface over which a means for sealing of the duct after completion of the gas filling can be arranged. The cross-sectional area of the second segment 13 is significantly smaller than the cross-sectional area of the first segment 12. By cross-sectional area is in this case meant the area that can be made up by the side walls between them transversely to the longitudinal direction of the duct. This difference in cross-sectional area means that the gas pressure in a gas-filled and sealed duct 7 is capable of expanding the first segment 12 to the required volume, but not the second segment 13. Thus, the second segment 13 will constitute a substantially flat surface also when the duct 7 is filled with gas. The sealing of the duct transversely to the second segment 13 can thus be performed without first having to expel a considerable amount of gas before the two opposite side walls 2 that define the duct 7 can be brought into contact with each other for sealing. To achieve this effect, the ratio of the cross-sectional area of the second segment 13 to that of the first segment 12 should be at least 1:150 in a circular cross-sectional geometry.

The second 13 and the third segment 14 of the duct are preferably on their insides provided with an embossed surface (not shown). The embossed surface makes it easy to separate the walls in connection with gas filling.

The duct 7 with the three segments 12, 13, 14 is in the shown embodiment oriented in such a manner that the third segment 14 is arranged adjacent to the upper part of the container blank 10, i.e. the portion through which the container blank is intended to be filled. However, it will be appreciated that the duct 7 can be oriented fully as desired.

Figure 3:
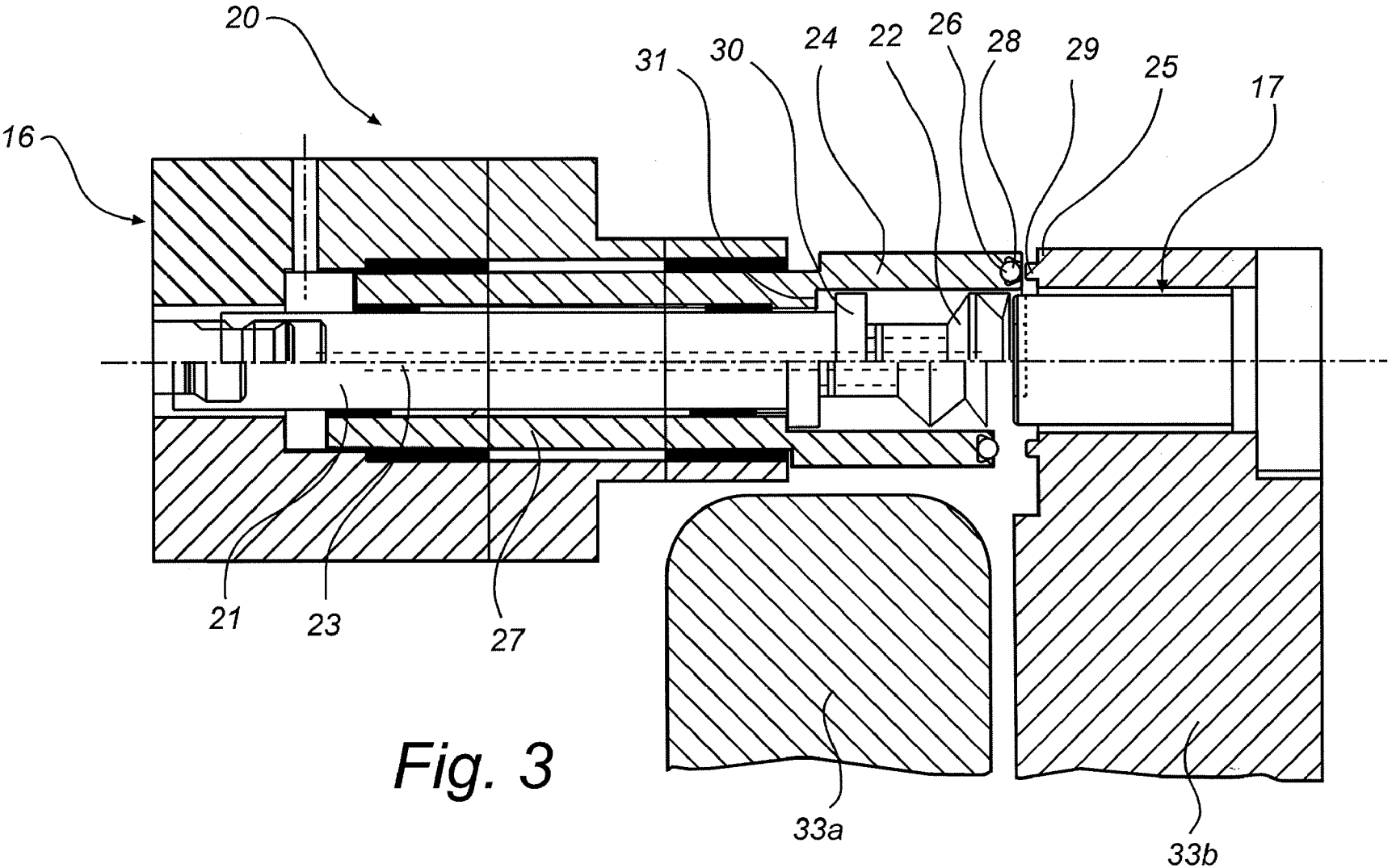
FIG. 3 schematically shows an embodiment of the device that is used for filling the handle with gas. The device is shown in a non-activated and an activated state respectively.

In the following, the device 16 which is intended for filling the above-described duct 7 with gas will be described with reference to FIG. 3. FIG. 3 is made up to show that, on the respective sides of a centre axis in the Figure, the device 16 is in its non-activated and activated state respectively.

The device 16 preferably constitutes a module in the equipment (not shown) that is used to manufacture a completed container 1 from a container blank 10. In such equipment, the module is mounted preferably in direct connection with the module that is used for heat sealing of the duct means through which the container has been filled.

Figure 4:
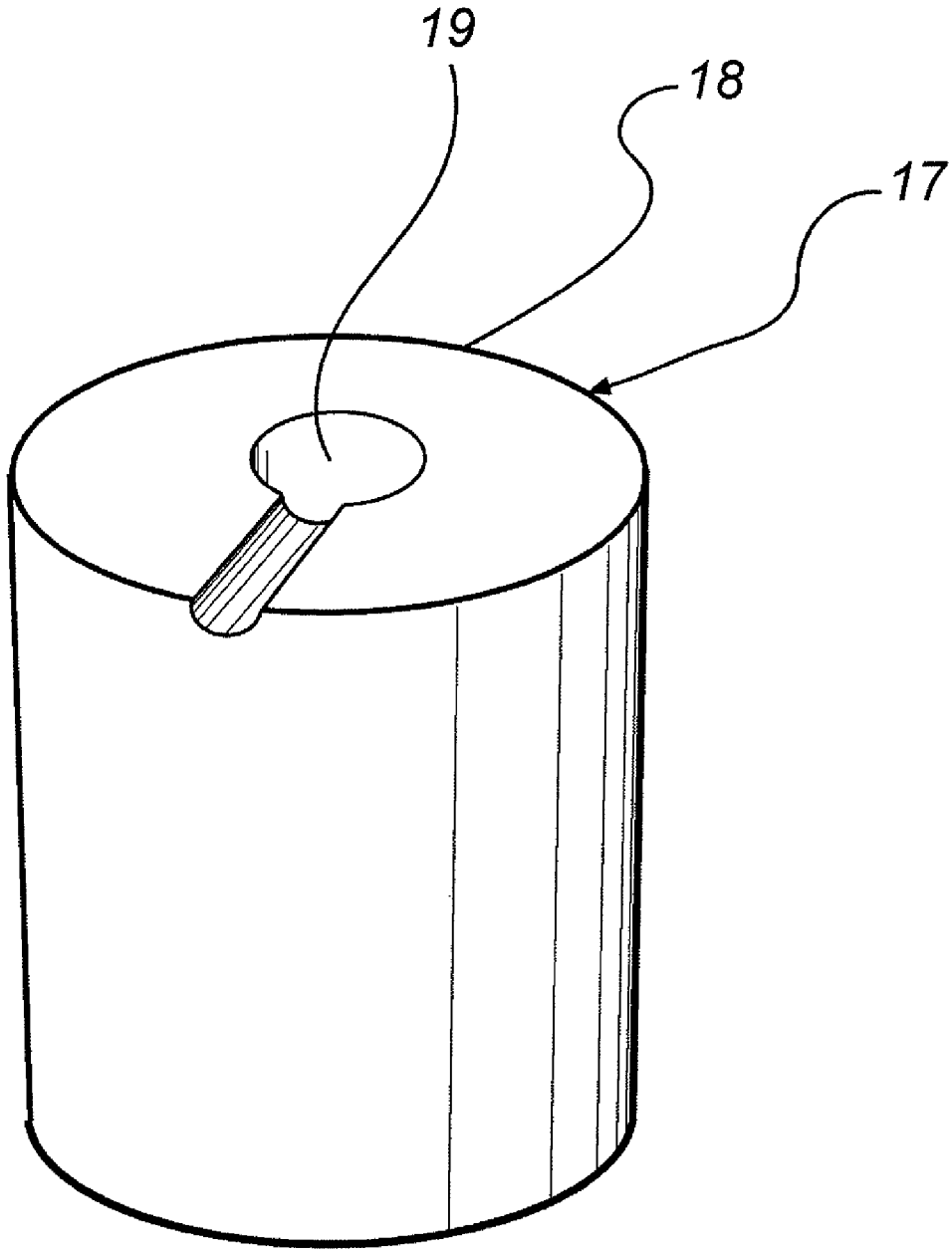
FIG. 4 shows the abutment used in the device.

The device 16 comprises an abutment 17 which is shown in detail in FIG. 4. In the shown embodiment, the abutment 17 consists of a circular rod 18. Of course, the abutment 17 may also have some other suitable shape. The abutment 17 has in its surface a recess 19 with a geometry corresponding at least to the third segment 14 of the duct 7, but preferably as shown in FIG. 4 a geometry corresponding to the third segment 14 and at least a part of the second segment 13. The purpose of the recess 19 is that one side wall 2 of the duct 7 should be allowed to bulge in the recess 19 during gas filling so that, although the container 1 is clamped by a grip over a part of the duct 7, an open passage is formed, through which the duct 7 can be filled with gas. The recess 19 is preferably of a size to allow minor position deviations between the container and the gas module, which will be described below, that is used while filling the duct 7 with gas.

The abutment 17 should be made of a material with low thermal conductivity, for instance insulated fibre glass. By low thermal conductivity is here meant that the abutment 17, even if it is enclosed by a heating jaw that has a sufficiently high temperature for melting of the material used in the container, has a temperature that prevents a container material abutting against the abutment 17 from melting.

The abutment 17 may also comprise cooling means (not shown) to ensure a suitable temperature.

A gas module 20 is arranged axially with the abutment 17. The gas module 20 comprises a first piston rod 21 which at its end facing the abutment 17 has a nozzle (not shown) which is enclosed by a packing means 22. The nozzle, on its own or in cooperation with, for instance, the packing means 20 or some other clamping means (not shown) of the first piston rod 21, is adapted to clamp the container 1 against the abutment 17 by clamping over that part of the container 1 which comprises at least the third segment 14, i.e. the hole that constitutes the inlet 15 to the duct 7. The packing means 22 can, as shown, consist of a bellows or, for instance, a sealing O ring. The packing means 22 should, during gas filling, provide the necessary seal around the inlet when this is applied to the inlet 15 for filling the duct 7 with gas.

The first piston rod 21 also comprises an axial bore 23 through which the nozzle by valves (not shown) communicates with a compressed air source (not shown).

The gas module 20 further comprises a sealing means 24 which comprises a mandrel 26 which is axially engageable with a heating jaw 25. In the shown embodiment, the mandrel 26 is arranged on a second piston rod 27 which concentrically encloses the first piston rod 21. More specifically, the mandrel 26 is arranged at the end of the second piston rod 27 that faces the abutment 17. It will, of course, be appreciated that the mandrel 26 need not enclose the first piston 21 concentrically, but they can also be arranged side by side. The mandrel 26 can be designed in various ways, for instance as shown in the form of a flexible O ring 28. In operation of the device, the mandrel 26 is adapted to form an abutment surface against a projection 29 of a heating jaw 25. In the shown embodiment, the heating jaw 25 encloses the abutment 17 axially. It will be appreciated that the O ring 28 can be replaced by some other suitable means that can cooperate with the heating jaw 25.

The projection 29 of the heating jaw 25 has an extent corresponding to the desired sealing surface 34 of the duct 7, i.e. the seal that disconnects the first segment 12 of the duct 7 from the rest of the duct 7. The sealing surface 34 is shown in FIG. 1. In the case illustrated, the annular projection 29 provides an annular sealing surface 34 around the inlet 15 in the third segment 14. The sealing surface 34 can also extend over a part of the second segment 13. It will thus be appreciated that the sealing surface 34 obtains the same geometry as the abutment surface between the projection 29 and the O ring 28.

In the case where the device 16 constitutes a module which is arranged directly connected to the module that is used to seal the duct means 8 of the container 1, through which the container is filled with its contents, this heating jaw 25 may constitute a part of the heating jaw (not shown) that is used to reseal the duct means 8.

Both the first 21 and the second 27 piston rod are at their ends facing away from the abutment 17 connected by valves (not shown) to a pneumatic control system (not shown) for controlling the motion of the piston rods 21, 27.

For simplified control of the piston rods 21, 27, the first piston rod 21 has on its outside a lug 30 which is adapted to cooperate with a complementary stepped recess 31 on the inside of the second piston rod 27, which recess concentrically encloses the first piston rod 21.

In the following the function of the device will be described with reference to FIG. 3.

A container (not shown in FIG. 3), whose duct 7 is ready to be filled with gas, is arranged between two supporting surfaces 33*a*, 33*b* in such a manner that the inlet 15 in the third segment 14, i.e. the hole, and the second segment 13 coincide with the recess 19 in the abutment 17. The container is oriented in such a manner that the inlet 15 is directed away from the abutment 17. The first piston rod 21 is activated, whereby it makes an outward stroke so that the nozzle (not shown) and the packing means 22 clamp a part of the container so that the packing means 22 makes airtight contact with the container and so that the nozzle abuts against the inlet 15. In this position, the valve (not shown) to the bore 23 through the first piston rod 21 is opened, thereby allowing gas to freely pass through the bore 23 and into the duct 7 for expanding the same. While gas is being supplied, the side wall 2 in the duct 7 that faces the abutment 17 is allowed to bulge in the recess 19 so that, in spite of the clamping of the container 1, a free passage is formed for the gas into the duct 7. The side wall portion in the third segment 14 that encloses the inlet 15 will, owing to the hole from the inlet 15, have a tendency towards resilience. As soon as an indication of resilience occurs, the gas will be able to escape into the resulting space between the side walls 2 and on to the remaining part of the duct 7. During gas filling, the separation of the side walls 2 can be facilitated by an internal embossment of the side walls in the second 13 and the third 14 segment. When the duct 7, and in particular its first segment 12, has expanded to the necessary pressure and volume, the valve is closed, and the supply of gas through the bore 23 is terminated.

Subsequently the second piston rod 27 makes its outward stroke, its mandrel 26 in the form of an O ring 28 pressing, for the required time and at the required pressure, the side walls 2 of the duct 7 against the projection 29 of the heating jaw 25, whereby a gas-tight weld joint 32 forms and seals the duct 7. The resulting sealing surface 34 is illustrated very schematically in FIG. 1. The heating jaw 25 is preferably oriented so as to act over the second segment 13 and/or over the third segment 14. The important thing is that the inlet 15 is disconnected from the rest of the duct 7. The heating jaw 25 can be used together with an insulated relief means (not shown) which is arranged next to the heating jaw on the side facing the gas-filled duct 7. The relief means is arranged on the same level as, or slightly below, the heating jaw and acts to remove/reduce an inner gas pressure in direct connection with the sealing. Such removal or reduction of the inner gas pressure means that the temperature of the heating jaw is not critical to the same extent for obtaining a gas-tight weld joint 32 that seals the duct 7.

After the necessary time, an inward stroke of the first piston rod 21 occurs to return this to its home position. During this inward stroke, the external lug 30 of the first piston rod 21 will engage the inner stepped recess 31 of the second piston rod 27, whereby the second piston rod 27 is entrained in the inward stroke so that this, too, returns to its home position.

The container 1 with the sealed gas-filled duct 7 is now free to be removed from the device 16 for further transport/treatment.

In the above-described device 16 and its function, the first piston rod 21 and the second piston rod 27 are arranged to operate in the same operating direction relative to the abutment 17 and the heating jaw 25 arranged around the abutment. It will be appreciated that the same final result can be achieved in other ways by minor changes of the device, which changes are all within the scope of protection of the invention.

In a variant, the heating jaw 25 can, for instance, be arranged on the second piston rod 27, in which case the heating jaw 25 by the motion of the second piston rod 27 is applied to the abutment 17 and a mandrel 26 cooperating therein with the heating jaw 25.

In another variant, the first and the second piston rods 21, 27 can be arranged to operate in mutually different operating directions and with a heating jaw 25 and a mandrel 26 which are suitably arranged for the motion.

The invention thus relates to a method and a device for gas filling and sealing of a duct 7 intended to be filled with gas and positioned in a container 1 of a collapsible type. The invention further relates to a container blank 10 with a duct 7 which is specially developed for the method and the device.

The method and the device are developed in such a manner that the functions relating to clamping of the container 1, gas filling of the duct 7 and sealing of the same can all be performed in one and the same operating direction, which allows a highly space-saving device 16. This means that the device 16 can without great difficulties be integrated into existing packing machines. The device 16 has a very simple construction that makes it simple to use, easy to maintain and to have a high rate of production.

The container blank 10 developed for the method and the device 16 has a duct 7 which can easily be filled with gas and sealed without new material or new components in the form of, for instance, check valves having to be added to the container. Such a duct 7 can thus easily be integrated in other types of container blanks.

It will be appreciated that the present invention is not limited to the embodiments shown. Several modifications and variations are thus conceivable within the scope of the invention which thus is exclusively defined by the appended claims.

The invention claimed is:

1. A method of gas filling and sealing of a duct intended to be filled with gas and positioned in a container of a collapsible type, said duct being defined by two opposite side walls which are joined along a connecting portion, and comprising an inlet arranged through one of the side walls, the method comprising:

clamping a part of the container, which part comprises said inlet, between an abutment and a gas module which is axially movable towards the abutment, in such a manner that one of the two side walls included in the duct is allowed, in response to a gas flow supplied from the gas module and entering the duct through said inlet, to bulge to form a free passage into the duct for filling the same with gas, the abutment is formed with a recess in its side facing the container to allow said bulge; and after completion of the gas filling, sealing the duct.

2. The method as claimed in claim 1, in which said part of the container is clamped by axial displacement of a nozzle and a packing means, which is arranged outside the same and associated with the gas module, in relation to said abutment.

3. The method as claimed in claim 1, in which the duct is sealed by applying heat and pressure to the part of the duct which abuts against the abutment.

4. The method as claimed in claim 1, wherein the container is formed of a container blank, said container blank including the duct, characterised in that the duct includes:

a first segment which after gas filling provides a geometry desired in the container;

a second segment adjoining the first segment, said second segment having a significantly smaller cross-sectional area than the first segment; and a third segment adjoining the second segment and comprising an inlet to the duct.

5. The method as claimed in claim 4, in which the inlet is a hole formed in one side wall.

6. The method as claimed in claim 5, in which the third segment is arranged in connection with a duct means of the container blank, through which duct means the container blank is adapted to be filled with its contents.

* * * * *

UNITED STATES PATENT AND TRADEMARK OFFICE

CERTIFICATE OF CORRECTION

PATENT NO. : 7,654,063 B2
APPLICATION NO. : 10/572553
DATED : February 2, 2010
INVENTOR(S) : Stefan Forss It is certified that error appears in the above-identified patent and that said Letters Patent is hereby corrected as shown below:

On the title page, item (30) Foreign Application Priority Data is incorrect:

"October 2, 2003 (SE) 0302633"

should read

--October 2, 2003 (SE) 0302633-3--.

Signed and Sealed this

Thirty-first Day of August, 2010

David J. Kappos

David J. Kappos
*Director of the United States Patent and Trademark Office*